US009988696B2

(12) United States Patent
Matsuoka et al.

(10) Patent No.: US 9,988,696 B2
(45) Date of Patent: Jun. 5, 2018

(54) RAIL COOLING METHOD AND RAIL COOLING DEVICE

(71) Applicant: JFE STEEL CORPORATION, Tokyo (JP)

(72) Inventors: Ryo Matsuoka, Tokyo (JP); Makoto Nakaseko, Tokyo (JP); Rinya Kojo, Tokyo (JP); Tomoo Horita, Tokyo (JP); Hideki Takahashi, Tokyo (JP); Yoshikazu Yoshida, Tokyo (JP); Tatsumi Kimura, Tokyo (JP); Mineyasu Takemasa, Tokyo (JP); Yuzuru Kataoka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 916 days.

(21) Appl. No.: 14/376,236

(22) PCT Filed: Feb. 1, 2013

(86) PCT No.: PCT/JP2013/052355

§ 371 (c)(1),
(2) Date: Aug. 1, 2014

(87) PCT Pub. No.: WO2013/115364

PCT Pub. Date: Aug. 8, 2013

(65) Prior Publication Data

US 2015/0027599 A1 Jan. 29, 2015

(30) Foreign Application Priority Data

Feb. 2, 2012 (JP) ..... PCT/JP2012/052345

(51) Int. Cl.

| | |
|---|---|
| ***C21D 1/667*** | (2006.01) |
| ***C21D 9/04*** | (2006.01) |
| ***C21D 1/18*** | (2006.01) |

(52) U.S. Cl.
CPC ..... *C21D 1/667* (2013.01); *C21D 1/18* (2013.01); *C21D 9/04* (2013.01);
(Continued)

(58) Field of Classification Search
CPC . C21D 1/18; C21D 1/667; C21D 1/84; C21D 1/63; C21D 9/04; C21D 2211/00;
(Continued)

(56) References Cited

U.S. PATENT DOCUMENTS

| | | | |
|---|---|---|---|
| 4,611,789 | A | 9/1986 | Ackert et al. |
| 4,749,419 | A | 6/1988 | Sommer et al. |
| 5,209,792 | A | 5/1993 | Besch et al. |

FOREIGN PATENT DOCUMENTS

| | | |
|---|---|---|
| JP | A-59-74227 | 4/1984 |
| JP | A-63-114923 | 5/1988 |

(Continued)

OTHER PUBLICATIONS

International Search Report issued in International Patent Application No. PCT/JP2013/052355 dated Apr. 9, 2013.

*Primary Examiner* — Colleen P Dunn
(74) *Attorney, Agent, or Firm* — Oliff PLC

(57) ABSTRACT

A rail cooling method for forcibly cooling a rail by jetting a coolant includes jetting the coolant to a foot back part of the rail from a porous plate nozzle in which a nozzle hole at an end in a width direction is smaller than a nozzle hole at a central part in the width direction and causes a cooling capacity for the end in the width direction of the underside of the base of the rail to be lower than a cooling capacity for the central part in the width direction of the underside of the base of the rail.

3 Claims, 6 Drawing Sheets

(52) U.S. Cl.
CPC .. *C21D 2211/001* (2013.01); *C21D 2211/009* (2013.01); *C21D 2221/00* (2013.01); *C21D 2221/02* (2013.01)

(58) Field of Classification Search
CPC ..... C21D 2211/02; C21D 2211/001; C21D 2211/009
See application file for complete search history.

(56) References Cited

FOREIGN PATENT DOCUMENTS

| | | | | |
|---|---|---|---|---|
| JP | 01290717 | A | * | 11/1989 |
| JP | A-1-290717 | | | 11/1989 |
| JP | A-6-17193 | | | 1/1994 |
| JP | A-7-216455 | | | 8/1995 |
| JP | A-10-130730 | | | 5/1998 |
| JP | A-2002-105538 | | | 4/2002 |
| JP | A-2006-289407 | | | 10/2006 |

* cited by examiner

RAIL COOLING METHOD AND RAIL COOLING DEVICE

FIELD

The present invention relates to a rail cooling method and a rail cooling device for forcibly cooling, with a coolant such as air or water, a high-temperature rail immediately after hot rolling or a high-temperature rail heated to an austenitic temperature range for heat treatment after hot rolling so that a head part thereof has a fine pearlitic microstructure.

BACKGROUND

Conventionally, to cause a head part of a rail to have the fine pearlitic microstructure to improve wear resistance and toughness of the rail, forcible cooling with the coolant such as air or water has been performed on the head part (a head top part and a head side part) of a high-temperature rail immediately after hot rolling or a high-temperature rail heated to an austenitic temperature range for heat treatment after hot rolling. In this case, if only the head part of the rail is forcibly cooled, an asymmetrical temperature range is formed in the vertical direction of the rail, so that the rail may be largely bent due to a stress existing inside the rail after cooling. So an underside of the base of the rail is also forcibly cooled.

Patent Literature 1 discloses a porous plate having cooling nozzle holes for forcibly cooling a rail. Patent Literature 2 discloses a technique for preventing a rail after forcible cooling from bending by starting forcible cooling of an underside of the base of the rail earlier than forcible cooling of a head part of the rail to precool the underside of the base. Patent Literature 3 discloses a technique for uniformizing hardness of a rail in the longitudinal direction by controlling a discharge amount of air for forcible cooling toward the vicinity of an end of the rail.

CITATION LIST

Patent Literature

Patent Literature 1: Japanese Laid-open Patent Publication No. 2002-105538

Patent Literature 2: Japanese Laid-open Patent Publication No. 10-130730

Patent Literature 3: Japanese Laid-open Patent Publication No. 7-216455

SUMMARY

Technical Problem

Rail manufacturing facilities are required to increase cooling speed for a rail to increase a production capacity thereof. As a countermeasure against the above, the number of porous plates having cooling nozzle holes may be increased, for example. In addition, as described later, material uniformity should be taken into consideration.

Conventionally, as quality of a rail, only quality of a rail head part to be in contact with a wheel has attracted attention. However, in recent years, demands for quality of a base of the rail have been increasing with a situation in which high-strength rails are increasingly demanded with increasing speed and weight of a railroad vehicle. Accordingly, it is expected to uniformize mechanical characteristic values represented by hardness of the base of the rail.

However, any of the Patent Literatures described above does not disclose a technique for uniformizing mechanical characteristic values in the width direction of the base of the rail.

The present invention is made in view of such a situation, and provides a rail cooling method and a rail cooling device that can uniformize the mechanical characteristic values in the width direction of the base of the rail.

Solution to Problem

To solve the above-described problem and achieve the object, a rail cooling method according to the present invention is a rail cooling method for forcibly cooling a rail by jetting a coolant and includes jetting the coolant to an underside of the base of the rail from a porous plate nozzle in which a nozzle hole at an end in a width direction is smaller than a nozzle hole at a central part in the width direction and causes a cooling capacity for the end in the width direction of the underside of the base of the rail to be lower than a cooling capacity for the central part in the width direction of the underside of the base of the rail.

Moreover, in the above-described rail cooling method according to the present invention, the nozzle holes have a circular shape, and a diameter of the nozzle hole at the end is 20% to 90% of a diameter of the nozzle hole at the central part.

Moreover, a rail cooling device according to the present invention is configured to forcibly cool a rail by jetting a coolant and includes a porous plate nozzle including a plurality of nozzle holes configured to jet the coolant that are opposed to an underside of the base of the rail to cool the underside of the base of the rail, wherein the nozzle hole at an end in a width direction is formed to be smaller than a nozzle hole at a central part to cause a cooling capacity for the end in the width direction of the underside of the base of the rail to be lower than a cooling capacity for the central part in the width direction of the underside of the base of the rail.

Moreover, in the above-described rail cooling device according to the present invention, the nozzle holes have a circular shape, and a diameter of the nozzle hole at the end is 20% to 90% of a diameter of the nozzle hole at the central part.

Advantageous Effects of Invention

According to the present invention, a flow rate of the coolant with respect to the end in the width direction of the underside of the base of the rail is controlled, so that the mechanical characteristic values in the width direction of the base of the rail can become uniform.

DESCRIPTION OF EMBODIMENTS

Figure 1:
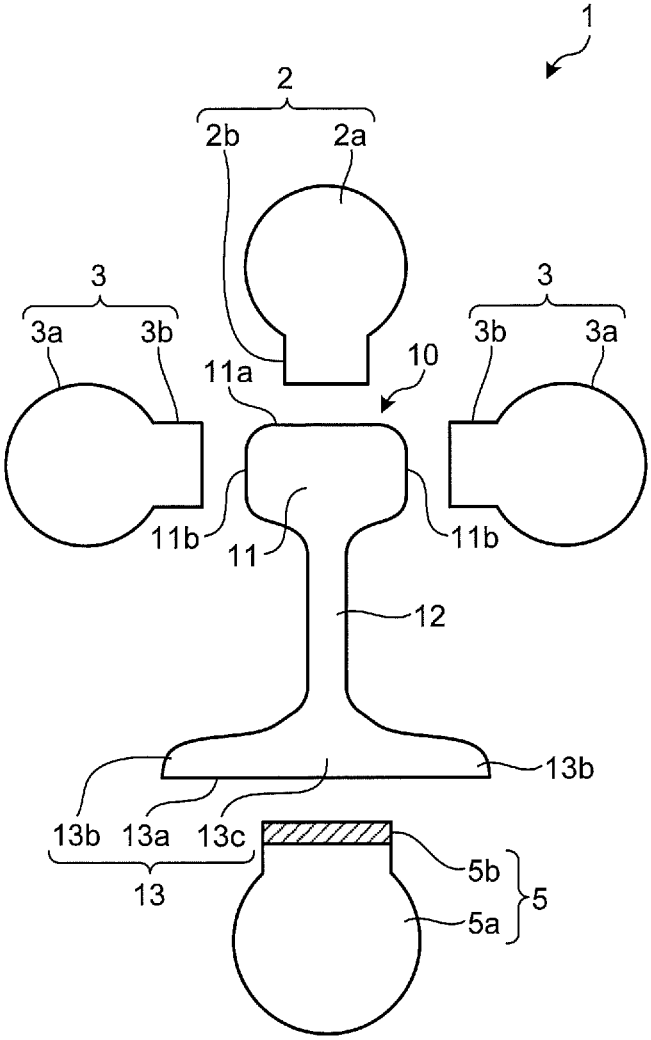
FIG. 1 is a schematic diagram illustrating a schematic configuration of a rail cooling device according to an embodiment of the present invention.

The following describes an embodiment of the present invention in detail with reference to drawings. The present invention is not limited to the embodiment. Through the drawings, the same components are denoted by the same reference numerals.

First, the following describes a schematic configuration of a rail cooling device 1 according to the embodiment with reference to FIG. 1. As illustrated in FIG. 1, the rail cooling device 1 cools a rail 10 that is conveyed in a high temperature state after hot rolling. The rail 10 and the rail cooling device 1 extend in a direction perpendicular to the sheet of the drawing. The rail cooling device 1 includes a head top part cooling device 2 that forcibly cools the entire length of a head top part 11*a* of a head part 11 of the rail 10, a head side part cooling device 3 that forcibly cools the entire length of head side parts 11*b* on both sides of the head part 11 of the rail 10, a cooling device for the underside of the base 5 that forcibly cools the entire length of an underside of the base 13*a* that is a back surface of a base 13 of the rail 10, and a coolant conveying tube (not illustrated) that supplies a coolant to each cooling device. The rail cooling device 1 is supported and restrained with a supporting and restraining device (not illustrated) that supports and restrains the base of the rail 10, and includes a mechanism (not illustrated) that causes the supporting and restraining device or the various cooling devices described above to oscillate (reciprocate) in the longitudinal direction of the rail.

The head top part cooling device 2 includes a head top part cooling nozzle header 2*a* and a head top part cooling nozzle 2*b* provided to the head top part cooling nozzle header 2*a*. The head side part cooling device 3 includes a head side part cooling nozzle header 3*a* and a head side part cooling nozzle 3*b* provided to the head side part cooling nozzle header 3*a*. The cooling device for the underside of the base 5 includes a cooling nozzle header for the underside of the base 5*a* and a porous plate nozzle 5*b* provided to the cooling nozzle header for the underside of the base 5*a*.

Figure 2:
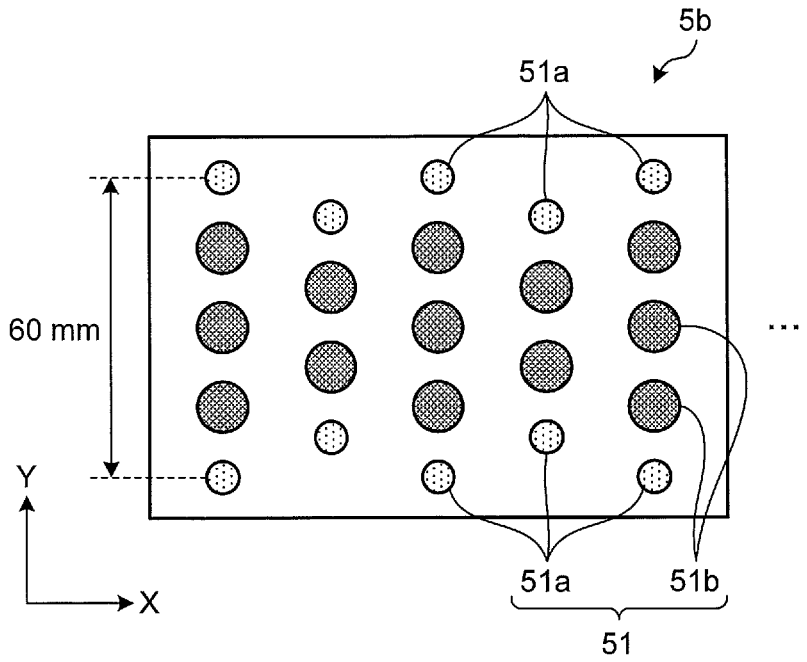
FIG. 2 is a plan view illustrating a configuration example of a porous plate nozzle according to the embodiment.

The porous plate nozzle 5*b* of the cooling device for the underside of the base 5 is arranged in a manner opposed to the underside of the base 13*a* of the rail 10. The porous plate nozzle 5*b* includes a plurality of nozzle holes arranged therein for jetting a coolant in the width direction of the rail 10 and the longitudinal direction of the rail 10. FIG. 2 is a plan view illustrating a configuration of the porous plate nozzle 5*b* of the cooling device for the underside of the base 5. As illustrated in FIG. 2, a large number of nozzle holes 51 for jetting a cooling medium are formed on substantially the entire surface of the porous plate nozzle 5*b* according to the embodiment. A plurality of nozzle holes 51 are arrayed in the width direction (Y-direction illustrated in FIG. 2) of the porous plate nozzle 5*b*, and a plurality of columns thereof are formed in the longitudinal direction (X-direction illustrated in FIG. 2). A distance between centers of nozzle holes 51*a* at both ends of each column is 60 mm at the maximum. The nozzle holes 51*a* at both ends of each column are smaller than nozzle holes 51*b* at a central part other than both ends. That is, an opening area of each of the nozzle holes 51*a* at both ends is set to be smaller than an opening area of each of the nozzle holes 51*b* at the central part.

An opening shape of each nozzle hole 51 may be an ellipse or a polygon. However, to facilitate processing of the nozzle hole, the opening shape of each nozzle hole 51 is preferably a circle. In this case, a diameter of each of the nozzle holes 51*a* at both ends of each column is preferably 20% or more and 90% or less of a diameter of each of the nozzle holes 51*b* at the central part, and more preferably, 50% or more and 85% or less thereof. In the embodiment, the diameter of each of the nozzle holes 51*a* at both ends of each column is formed to be 20% or more and 90% or less of the diameter of each of the nozzle holes 51*b* at the central part other than both ends.

To further optimize the size of the nozzle holes 51 (for example, a nozzle diameter) at the central part and at both ends, the following method may be employed. Among three main factors in cooling behavior on a surface of the underside of the base 13*a* of the rail 10, that is, a distance between the surface of the underside of the base 13*a* and the nozzle hole 51 (hereinafter, referred to as a jet distance), an interval between the nozzle holes 51 in the width direction (hereinafter, also simply referred to as a nozzle interval), and a size of the nozzle hole 51 (hereinafter, represented by the nozzle diameter for description), the jet distance that is largely affected by restrictions on a device is assumed to be a constant value. In addition, influence of the nozzle diameter and the nozzle interval on a distribution of the cooling behaviors (for example, a heat transfer coefficient on the surface of the underside of the base 13*a*) in the width direction is examined to determine the nozzle diameter and the nozzle interval so that the cooling speed is substantially the same at a central part 13*c* and at both ends 13*b* of the base 13 while taking a thickness distribution of the base 13 into consideration.

The maximum value of the distance between the centers of the nozzle holes 51*a* at both ends of each column is preferably 30% or more of the width of the underside of the base 13*a* of the rail 10. As an arrangement of the nozzle holes 51, a staggered arrangement may be employed as illustrated in FIG. 2.

The porous plate nozzle 5*b* is arranged so that a center line in the width direction thereof coincides with a center line in the width direction of the rail 10. The cooling device for the underside of the base 5 of the rail cooling device 1 then jets the coolant from the porous plate nozzle 5*b* to forcibly cool the entire length of the underside of the base 13*a* of the rail 10.

With the porous plate nozzle 5*b* configured as described above, the flow rate of the coolant to the underside of the base 13*a* of the thin end 13*b* in the width direction of the base 13 of the rail 10 is controlled to be smaller than that to the central part in the width direction of the underside of the base 13*a*, so that a cooling capacity for the end in the width direction of the underside of the base 13*a* of the rail is lowered compared to a cooling capacity for the central part in the width direction of the underside of the base 13*a*. Accordingly, the temperature lowering speed is controlled at the end 13*b* in the width direction of the base 13, and a difference between the cooling speed for the end 13*b* and the cooling speed for the central part 13*c* in the width direction of the base 13 is reduced, so that variation in the mechanical characteristic values in the width direction of the base 13 of the rail 10 can be suppressed.

Conventionally, a ratio of the maximum value of the distance between the centers of the nozzle holes 51*a* at both ends in the width direction of the porous plate nozzle 5*b* to the width of the underside of the base 13*a* of the rail 10 has been normally about 15 to 25%. When the ratio is increased to 30% or more, the flow rate of the coolant to the entire underside of the base 13*a* of the rail 10 is increased, so that time required for cooling can be shortened.

Regarding the arrangement of the nozzle holes 51 in the porous plate nozzle 5*b*, by reducing a density of the nozzle holes at the end in the width direction with respect to that at the central part in the width direction, that is, by reducing the number of nozzle holes 51 per unit length in the longitudinal direction at the end in the width direction with respect to that at the central part in the width direction, the cooling capacity for the end in the width direction of the underside of the base 13*a* is set to be lower than the cooling capacity for the central part of the underside of the base 13*a*, so that it is possible to reduce a difference between average cooling speed at the end 13*b* and average cooling speed at the central part 13*c* in the width direction of the base 13. However, in this case, the mechanical characteristic values of the base 13 of the rail 10 cannot become uniform in the width direction due to the following reason. As described above, the rail cooling device 1 forcibly cools the rail 10 while oscillating (reciprocating) the supporting and restraining device for the rail 10 and various cooling devices in the longitudinal direction of the rail 10. That is, a jet of the coolant is prevented from concentrating on a specific position in the longitudinal direction by reciprocating the nozzle holes 51 in the longitudinal direction of the rail 10. The coolant from the nozzle hole 51*a* intermittently strikes a certain position in the longitudinal direction of the rail 10 by performing the oscillation, so that cooling and non-cooling are alternatively repeated. When the density of the nozzle holes 51*a* in the porous plate nozzle 5*b* is set to be smaller at the end in the width direction than the density of the nozzle holes 51*b* at the central part in the width direction, the interval between the nozzle holes 51*a* adjacent to each other in the longitudinal direction increases at the end in the width direction. In this case, time during which the coolant strikes the end in the width direction of the underside of the base 13*a* of the rail 10 while the nozzle hole 51*a* reciprocates once is shortened, so that a recuperative process occurs during the non-cooling operation. Accordingly, even if the average cooling speed at the end 13*b* in the width direction of the base 13 may be equal to the average cooling speed at the central part 13*c* from cooling start to cooling end, it is not possible to reduce variation in the mechanical characteristic values in the width direction or in the longitudinal direction of the base 13.

If an oscillation cycle is shortened, the recuperative process during the non-cooling operation of the rail 10 is prevented from occurring even when the density of the nozzle holes 51 in the porous plate nozzle 5*b* is smaller at the end than that at the central part in the width direction. However, to shorten the oscillation cycle, it is necessary to move the supporting and restraining device for the rail 10 or the various cooling devices in the longitudinal direction of the rail 10 at high speed, which is not practical.

Instead, when the diameter of the nozzle hole 51 in the porous plate nozzle 5*b* is reduced and the number of nozzle holes 51 per unit length in the longitudinal direction is increased, the recuperative process during the non-cooling operation of the rail 10 is prevented from occurring even if the density of the nozzle holes 51 in the porous plate nozzle 5*b* is smaller at the end than that at the central part in the width direction. Herein, to prevent the nozzle hole 51 from being clogged with dust and dirt, the diameter of the nozzle hole 51 is preferably 1 mm or more. However, with the nozzle hole 51 having the diameter of 1 mm or more, even if the number thereof is increased, the mechanical characteristic values of the base 13 of the rail 10 cannot become uniform in the width direction when the present density thereof at the end is smaller than that at the central part in the width direction.

Based on the above reason, in the porous plate nozzle 5*b* according to the embodiment, the density of the nozzle holes 51 is the same at the end in the width direction and at the central part, and the nozzle hole 51*a* at the end in the width direction is formed to be smaller than the nozzle hole 51*b* at the central part.

As described above, with the rail cooling device 1 according to the embodiment, the flow rate of the coolant to the end in the width direction of the underside of the base 13*a* of the rail 10 is controlled, so that the difference between the cooling speed at the end 13*b* in the width direction and the cooling speed at the central part 13*c* of the base 13 is reduced and the mechanical characteristic values can become uniform in the width direction of the base 13 of the rail 10. The flow rate of the coolant to the entire underside of the base 13*a* of the rail 10 is increased, so that the time required for cooling can be shortened.

In the embodiment described above, it is assumed that the diameters of only the nozzle holes 51*a* at the ends in the width direction of the porous plate nozzle 5*b* are reduced. Alternatively, the diameter of the nozzle hole is formed to be smaller toward the end taking the diameter of the nozzle hole at the center in the width direction of the porous plate nozzle 5*b* as the maximum.

The embodiment described above is merely an example for implementing the present invention. The present invention is not limited thereto. Various modifications corresponding to a specification and the like are within the scope of the present invention. It is obvious from the above description that other various embodiments can be employed within the scope of the present invention.

EXAMPLE

Figure 3:
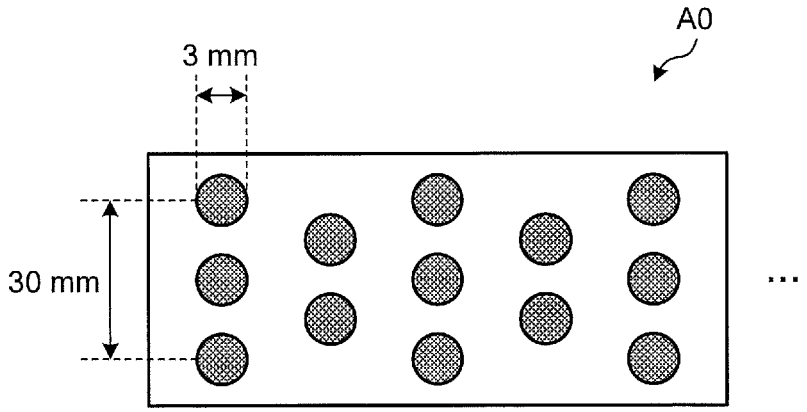
FIG. 3 is a plan view illustrating a porous plate nozzle of a standard model used for an experiment of rail cooling processing.

In the present example, an experiment of the rail cooling processing was performed with the rail cooling device 1 according to the embodiment while changing the configuration of the porous plate nozzle 5*b*. A width of an underside of the base of a rail used for the experiment is 152 mm. FIGS. 3 to 6 are plan views illustrating a model of the porous plate nozzle used in the experiment. FIG. 3 illustrates the porous plate nozzle of model A0 serving as a standard. In the porous plate nozzle of the standard model A0, the diameter of all the nozzle holes is 3 mm, the distance between the centers of the nozzle holes adjacent to each other in the width direction is 15 mm, and the distance between the centers of the nozzle holes at both ends in the width direction is 30 mm at the maximum and 15 mm at the minimum. Columns of the nozzle holes arranged in the width direction are arranged in the longitudinal direction with an interval of 15 mm. A column in which the distance between the centers of the nozzle holes at both ends in the width direction is 30 mm and another column in which the distance between the centers of the nozzle holes at both ends in the width direction is 15 mm are alternately arranged.

Figure 4:
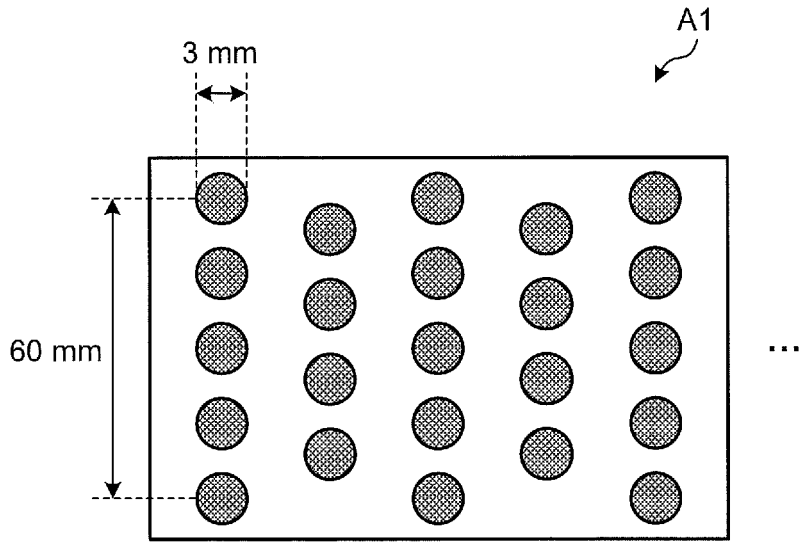
FIG. 4 is a plan view illustrating a porous plate nozzle of a model used for the experiment of the rail cooling processing.

FIG. 4 illustrates the porous plate nozzle of model A1 that is different from the standard model A0 in the width and the number of nozzle holes in a column of the nozzle holes in the width direction. In the porous plate nozzle of the model A1, the diameter of all the nozzle holes is 3 mm, the distance between the centers of the nozzle holes adjacent to each other in the width direction is 15 mm, and the distance between the centers of the nozzle holes at both ends in the width direction is 60 mm at the maximum and 45 mm at the minimum. Columns of the nozzle holes arranged in the width direction are arranged in the longitudinal direction with an interval of 15 mm. A column in which the distance between the centers of the nozzle holes at both ends in the width direction is 60 mm and a column in which the distance between the centers of the nozzle holes at both ends in the width direction is 45 mm are alternately arranged.

Figure 5:
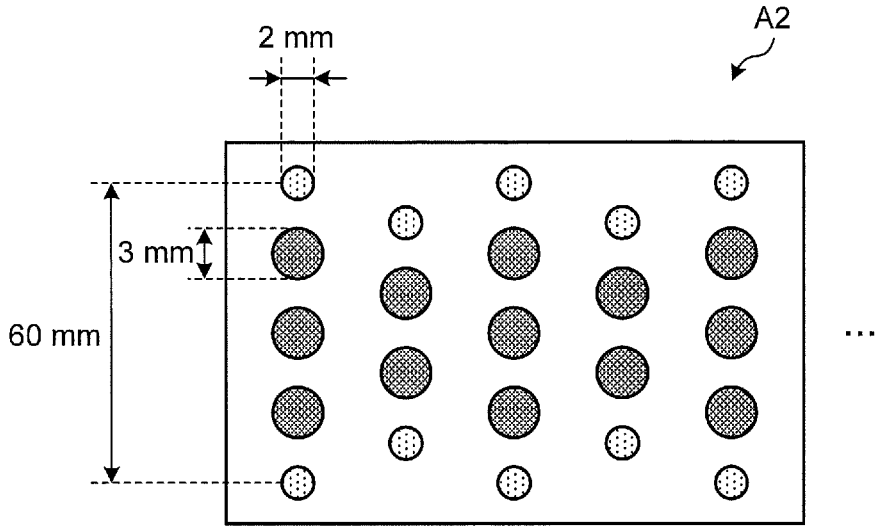
FIG. 5 is a plan view illustrating the porous plate nozzle of the model used for the experiment of the rail cooling processing.

FIG. 5 illustrates the porous plate nozzle of model A2 in which a width dimension and a distance between the centers of the nozzle holes adjacent to each other in the width direction are the same as those in the model A1 illustrated in FIG. 4, and the nozzle holes at both ends of each column in the width direction are smaller than the nozzle holes at the central part. In the porous plate nozzle of the model A2, the distance between the centers of the nozzle holes at both ends in the width direction is 60 mm at the maximum and 45 mm at the minimum, the diameter of the nozzle holes at both ends of each column in the width direction is 2 mm, and the diameter of the nozzle holes at the central part other than both ends is 3 mm. Columns of the nozzle holes arranged in the width direction are arranged in the longitudinal direction with an interval of 15 mm. A column in which the distance between the centers of the nozzle holes at both ends in the width direction is 60 mm and a column in which the distance between the centers of the nozzle holes at both ends in the width direction is 45 mm are alternately arranged. That is, the model A2 corresponds to the porous plate nozzle 5*b* in the embodiment described above.

Figure 6:
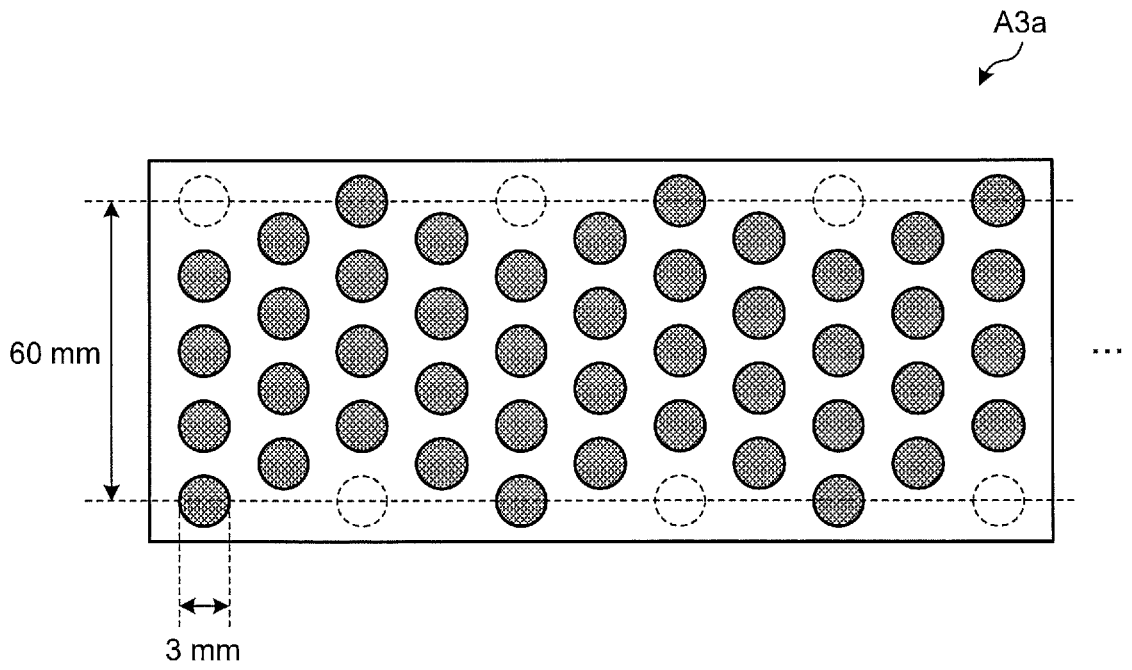
FIG. 6 is a plan view illustrating the porous plate nozzle of the model used for the experiment of the rail cooling processing.
Figure 7:
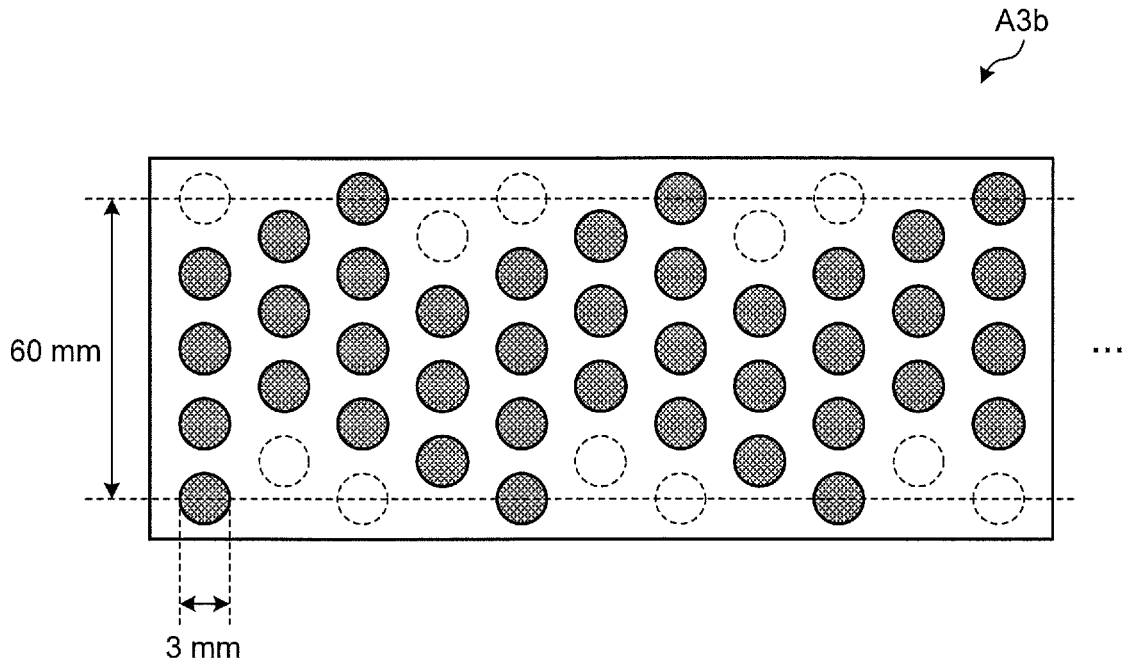
FIG. 7 is a plan view illustrating the porous plate nozzle of the model used for the experiment of the rail cooling processing.
Figure 8:
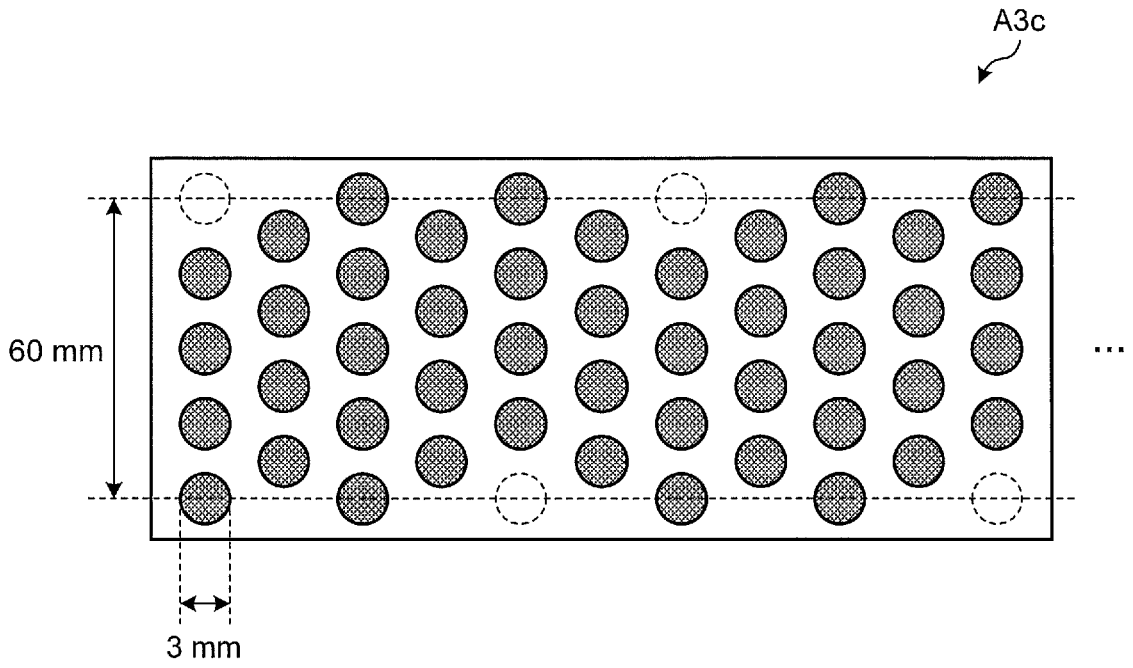
FIG. 8 is a plan view illustrating the porous plate nozzle of the model used for the experiment of the rail cooling processing.

FIGS. 6 to 8 illustrate the porous plate nozzles of model A3*a* to model A3*c*, respectively, in which the number of the nozzle holes at the ends in the width direction are reduced from the model A1 illustrated in FIG. 4, and the density of the nozzle holes at the ends in the width direction is set to be smaller than the density of the nozzle holes at the central part in the width direction. FIG. 6, FIG. 7, and FIG. 8 illustrate the three models A3*a*, A3*b*, and A3*c*, respectively, in which a method for reducing the nozzle holes at the ends is modified. Circles indicated by a dashed line in FIGS. 6 to 8 represent positions of the nozzle holes that are reduced from the model A1. Magnitude of the density of the nozzlesi holes at the end is as follows: A3*b*<A3*a*<A3*c*. In all the cases of models A0, A1, A2, A3*a*, A3*b*, and A3*c*, air is used as the coolant that is jet from the porous plate nozzle. The underside of the base 13*a* is cooled for three minutes by oscillating the rail 10 against the cooling device for the underside of the base 5 at an amplitude of 3 m and at the maximum speed of 200 mm/second.

Figure 9:
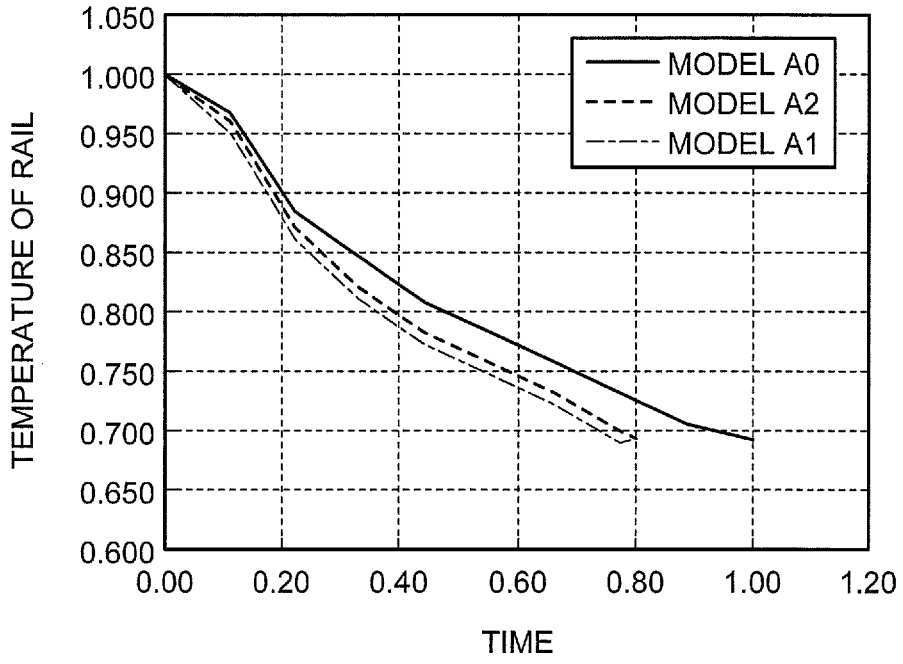
FIG. 9 is a diagram illustrating results of the experiment of the rail cooling processing.
Figure 10:
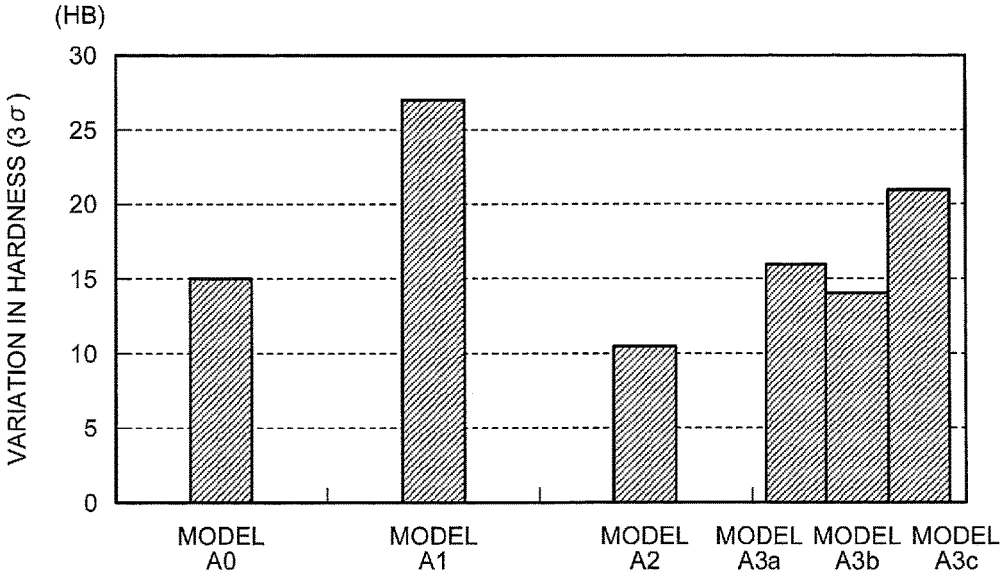
FIG. 10 is a diagram illustrating results of the experiment of the rail cooling processing.

FIG. 9 and FIG. 10 illustrate results of the experiment of the rail cooling processing. FIG. 9 illustrates cooling behaviors on the rail 10 with the models A0 to A2. In FIG. 9, time during which an average temperature of the underside of the base 13*a* of the rail 10 is lowered to a predetermined temperature (time required for cooling) using the model A1 and model A2 is compared to the case with the standard model A0. The horizontal axis in FIG. 9 represents relative values of time based on the time required for cooling in the case of the standard model A0 that is taken as 1. The vertical axis in FIG. 9 represents relative values of temperature based on the average temperature (° C.) of the underside of the base 13*a* of the rail 10 at the time of cooling start that is taken as 1. As illustrated in FIG. 9, the time required for cooling is shortened with the model A1 and the model A2 as compared to the case with the standard model A0. This may be because the flow rate of the coolant is increased by expanding the width of the porous plate nozzle and the time required for cooling is shortened.

FIG. 10 is a diagram illustrating variation in hardness (Brinell hardness) in the width direction of the base 13 after forced cooling with each model by taking 3*a* that is three times a standard deviation a in the vertical axis. As illustrated in FIG. 10, the variation in hardness with the model A1 is larger than that with the model A0, and the variation in hardness with the model A2 is the smallest. This may be because the diameter of the nozzle holes is reduced at both ends of each column in the width direction of the model A2, so that the flow rate of the coolant to the ends in the width direction of the underside of the base 13*a* is controlled and the difference between the cooling speed at the end and the cooling speed at the central part 13*c* in the width direction of the base 13 is reduced. On the other hand, it is considered that the flow rate of the coolant to the ends of the underside of the base 13*a* is locally increased in the model A1 because the width of the porous plate nozzle is expanded, so that the difference between the cooling speed at the end 13*b* in the width direction of the base 13 and the cooling speed at the central part 13*c* is increased.

In the case of the models A3*a*, A3*b*, and A3*c*, variation in hardness in three examples are presented, where the method for reducing the number of the nozzle holes at the ends is modified. Any of numerical values thereof is smaller than that of the model A1 but larger than that of the model A2. This may be because, when the number of nozzle holes at the ends in the width direction is reduced, time during which the nozzle hole is not opposed to the end in the width direction of the underside of the base 13*a* is elongated during one oscillation (reciprocation), cooling is not sufficiently performed, and the recuperative process occurs, so that a difference between the hardness at the end 13*b* in the width direction of the base 13 and the hardness at the central part 13*c* is increased and the variation in hardness increases in the entire base 13. Even when the maximum speed of the oscillation is changed within a range of practical operation, the mechanical characteristic values of the base 13 of the rail 10 could not be equalized between the end 13*b* in the width direction and the central part 13*c*. Accordingly, it has been found that, when the density of the nozzle holes is set being equal between the end in the width direction and the central part as in the model A2 and the diameter of the nozzle holes at both ends of each column in the width direction is reduced, the variation in the mechanical characteristic values in the width direction of the base 13 of the rail 10 can be preferably suppressed.

Figure 11:
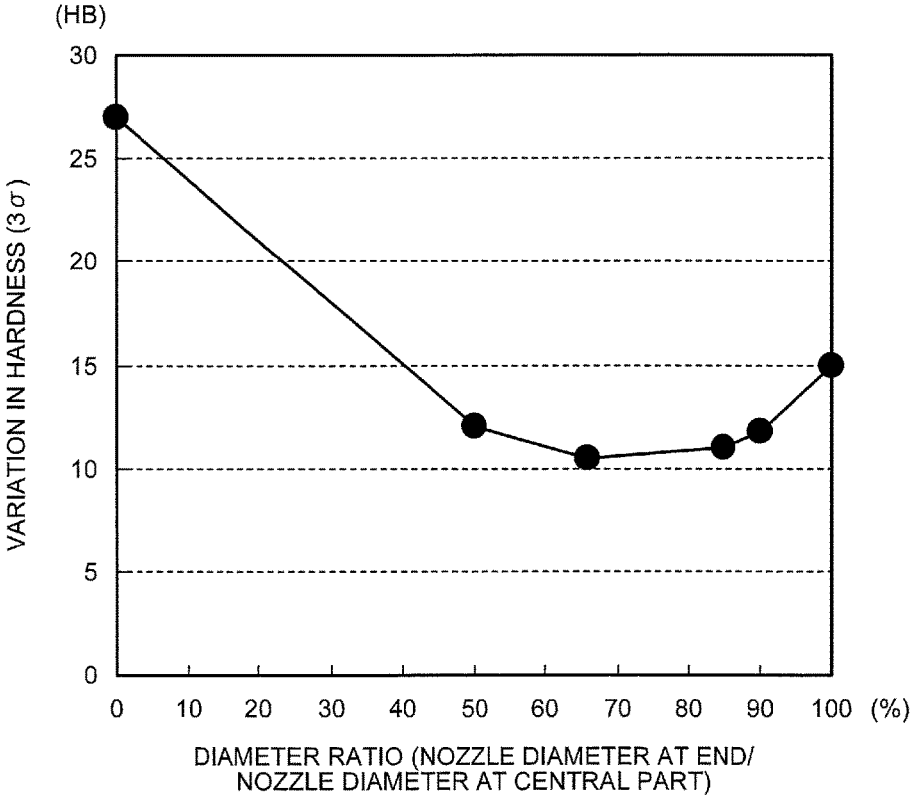
FIG. 11 is a diagram illustrating results of the experiment of the rail cooling processing.

FIG. 11 is a diagram illustrating a relation between a ratio between a diameter of the nozzle hole at the end of each column in the width direction and a diameter of the nozzle hole at the central part in the model A2, and variation in hardness in the width direction of the base 13. As illustrated in FIG. 11, it has been found that the variation in the mechanical characteristic values in the width direction of the base 13 of the rail 10 can be preferably suppressed within a range in which the ratio between the diameter of the nozzle hole at the end and the diameter of the nozzle hole at the central part is 20% or more and 90% or less, more preferably, 50% or more and 85% or less.

INDUSTRIAL APPLICABILITY

The present invention can be applied to processing for forcibly cooling, with the coolant such as air or water, the high-temperature rail immediately after hot rolling or the high-temperature rail heated to the austenitic temperature range for heat treatment after hot rolling to cause the head part of the rail to have a fine pearlitic microstructure.

REFERENCE SIGNS LIST

1 Rail cooling device
2 Head top part cooling device
3 Head side part cooling device
5 Cooling device for the underside of the base
5*a* Cooling nozzle header for the underside of the base
5*b* Porous plate nozzle
51 Nozzle hole
51*a* Nozzle hole at an end
51*b* Nozzle hole at a central part
10 Rail
11 Head part
12 Web part
13 Base
13*a* Underside of the base
13*b* End
13*c* Central part

The invention claimed is:

1. A rail cooling method for forcibly cooling a rail by jetting a coolant, the rail cooling method comprising:

jetting the coolant to an underside of a base of the rail from a porous plate nozzle including a plurality of nozzle holes, wherein ends in a width direction of the porous plate nozzle correspond to ends of the underside of the base of the rail, nozzle holes of the porous plate nozzle at the ends of the width direction are smaller than nozzle holes of the porous plate nozzle at a central part in the width direction causing a cooling capacity of the porous plate nozzle at the ends in the width direction to be lower than a cooling capacity of the porous plate nozzle for the central part in the width direction, and a maximum value of a distance between centers of the nozzle holes at both ends in the width direction is 30% or more of a width of the underside of the base.

2. The rail cooling method according to claim 1, wherein an arrangement of the nozzle holes is a staggered arrangement.

3. The rail cooling method according to claim 1, wherein the nozzle holes have a circular shape, and a diameter of the nozzle holes at the ends is 20% to 90% of a diameter of the nozzle holes at the central part.

* * * * *